United States Patent [19]

Arnett, Jr.

[11] 4,274,292

[45] Jun. 23, 1981

[54] COMPACT STARTER ASSEMBLY

[76] Inventor: Robert D. Arnett, Jr., 4534 College Park, Dallas, Tex. 75229

[21] Appl. No.: 83,766

[22] Filed: Oct. 11, 1979

[51] Int. Cl.[3] ..... F02N 7/08; F02N 15/02

[52] U.S. Cl. ..... 74/6; 74/7 E; 74/421 A; 123/179 F

[58] Field of Search ..... 74/6, 7 R, 7 A, 7 E, 74/421 A; 123/179 F

[56] References Cited

U.S. PATENT DOCUMENTS

| | | | |
|---|---|---|---|
| 1,217,815 | 2/1917 | Payne | 74/421 A X |
| 2,014,258 | 9/1935 | Lansing | 74/7 R X |
| 2,882,421 | 4/1959 | Mendenhall | 290/38 |
| 3,021,715 | 2/1962 | Lorean et al. | 74/7 R |
| 3,463,951 | 8/1969 | Bauerle et al. | 310/51 |
| 3,744,467 | 7/1973 | Wagner | 123/179 BG |
| 3,771,372 | 11/1973 | Asahi et al. | 74/7 R |
| 3,816,040 | 6/1974 | Janik | 123/179 F X |
| 3,999,531 | 12/1976 | Taylor | 123/196 M |
| 4,080,541 | 3/1978 | Mazzorana | 123/179 R X |

*Primary Examiner*—Allan D. Herrmann
*Attorney, Agent, or Firm*—Dennis T. Griggs

[57] ABSTRACT

A compact starter for internal combustion engines features a torque transfer assembly in which a drive motor and a drive pinion are mounted in side-by-side, parallel relation. The power shaft of the drive motor and the pinion shaft of the pinion are coupled together in driving engagement by a gear train assembly including a housing having coupling surfaces which permit the drive motor and drive pinion to be positionally rotated independently with respect to each other for accomodating the mounting clearance requirements of different engines. The gear train assembly features an idler gear which transfers torque from a motor pinion mounted on the power shaft and a pinion gear mounted on the pinion shaft. The idler shaft is confined between the drive motor and the torque transfer housing in a compact arrangement which permits efficient torque transfer in the side-by-side, parallel mounting arrangement without interferring with independent mounting adjustment of the drive motor relative to the drive pinion. The structure of the drive pinion shaft is simplified by a bearing support arrangement in which one end of the pinion drive shaft is journaled within the pinion housing, with the opposite end being journaled within the gear housing on a roller bearing assembly mounted on an extended bearing surface of the drive gear and confined within the gear train housing. According to this bearing arrangement, the conventional bearing adapters are eliminated and the machining operations required for producing multiple shaft diameters for use with the bearing adapters are avoided.

3 Claims, 6 Drawing Figures

COMPACT STARTER ASSEMBLY

BACKGROUND OF THE INVENTION

1. Field of the Invention

The present invention relates to improvements in starters for internal combustion engines, and in particular to the structure of a gear train assembly which couples a drive motor to a drive pinion in a compact arrangement.

2. Description of the Prior Art

An internal combustion engine is generally started by rotating its flywheel until the engine fires and continues to run under its own power. The flywheel is usually rotated by an electric starter motor energized by current from a storage battery. Gasoline engines must be started at a speed of 50 to 60 RPM; diesel engines generally require about 100 RPM. The shaft of the starter is provided with a pinion (a small gear wheel) which, on commencement of the starting operation is shifted forward until it engages the toothed rim on the flywheel. The drive motor of the starter then rotates the flywheel. When the engine has started, the starter pinion is disengaged from the flywheel and retracted. The various types of starters which are in present day use differ mainly in the manner in which engagement and disengagement is effected.

Electric starter motors generally fall under two categories: (a) pinion shift starters and (b) inertia gear drive starters (Bendix type). In the pinion shift starter, when the starter is actuated, the connection between the storage battery and a solenoid switch is established. A powerful magnetic field is set up in the magnetic coil of the switch, which causes the armature to be drawn, slowly rotating, into the magnetic field to engage the toothed rim of the flywheel. In the inertia gear drive starter arrangement, the pinion is shifted along the armature shaft on a quick-screw thread. When the starter button is actuated, the armature of the solenoid switch is attracted and the pinion is pushed forward, while it rotates, by an engaging lever. As the armature of the starter begins to rotate, it advances the pinion until it engages the gear rim on the flywheel. The solenoid switch is held in position by a holding coil, whereupon the electric starter motor can turn the engine.

A common feature of both types of electrical starters is the elongated configuration in which the armature of the starter motor is mechanically coupled in tandem with the pinion shaft thereby producing an unusually long assembly. Additionally, the solenoid switch is usually mounted in parallel with the armature structure and its position relative to the armature it is fixed and cannot be adjusted. The solenoid engaging lever of the electrical drive starters also occupies a substantial amount of space and cannot be moved relative to starter assembly to accomodate mounting variations on the engine to which the assembly is attached.

Although improvements have been made to the conventional electric starter to further reduce its length and overall mounting diameter, there are many applications in which the electric starters cannot be used or are unsuitable for other reasons. For example, most internal combustion engines have at least some difficulty in starting when they are cold. When they are exceptionally cold, as when exposed to extremely low ambient temperature, the difficulty is further compounded. Some engines are exposed to extreme weather conditions and are left unused for long periods of time. Under such conditions, it is sometimes necessary to rotate the flywheel continuously for a long period of time in order to start the engine. It will be appreciated that electric drive motors are not well suited for such extended starting operations because of the risk of overheat and burnout of the armature due to the heavy current loads required. A distinctly different class of starters, the air motor, is especially well adapted for such starter applications since the air motor can generate a large amount of power in a small frame size and there is no reduction of its power output at low temperatures as there would be with battery operated electric starters. Further, since compressed air is used as the source of power for an air starter, it can produce the required starting torque continuously without risk of overheating. Additionally, for remote applications such as oil production operations, compressed air or hydraulic power may be available, while electric power would not be available. The air starter also has a weight advantage since the heavy batteries are not required.

Although the conventional air start motors perform extremely well under hard start, cold weather conditions, conventional units which are presently available have an elongated configuration in which the drive pinion is coupled in direct axial alignment with the rotor of the air start motor, or is coupled in axially offset, tandem relation with the starter motor by a gear assembly. In either configuration, the overall length makes the assembly incompatible as a universal starter for various sizes of gasoline and diesel engines. Usually, only a limited amount of space is provided adjacent the flywheel housing for mounting the starter motor. The axial and radial clearances of the mounting space is sometimes limited by external engine components and parts such as wiring, fuel lines, mounting brackets and the like. Therefore, for some installations, the available mounting space will only accept a starter motor having a compact overall size, such as an electrical starting motor. However, as previously pointed out, for some applications it is desirable to use an air start motor instead of an electrical motor. Because the length of the air motor and the length of the pinion drive are determined substantially by the horsepower rating, a further reduction in overall length for the extended, tandem air start motor arrangement cannot be expected.

SUMMARY OF OBJECTS OF THE INVENTION

It is, therefore, the principal object of the present invention to provide a starter having a minimum axial length for mounting on an internal combustion engine in which the available starter mounting space is limited.

A related object of the invention is the provision of a starter assembly having a drive motor and a drive pinion which are rotatably adjustable with respect to each other for accomodating the variable mounting geometry associated with internal combustion engines.

Yet another object of the invention is to provide a gear train assembly for coupling a drive motor in driving engagement with a pinion gear in which the power shaft of the drive motor assembly is disposed in side-by-side, parallel relation with the drive pinion shaft in a minimum axial length configuration.

Still another object of the invention is to provide a compact starter assembly in which starting torque is efficiently transmitted to a drive pinion by a gear train which is mechanically supported and stabilized by the drive motor and the drive pinion.

A further object of the invention is to provide an improved pinion shaft and bearing support for a pinion drive assembly.

SUMMARY OF THE INVENTION

According to the novel features of the present invention, the foregoing objects are achieved by a compact starter for internal engines which features a torque transfer assembly in which a drive motor and a drive pinion are mounted in side-by-side, parallel relation. The power shaft of the drive motor and the pinion shaft are coupled together in driving engagement by a gear train assembly, including a housing having coupling surfaces which permit the drive motor and drive pinion to be positionally rotated independently with respect to each other for accomodating the mounting clearance requirements of different engines. The gear train assembly features an idler gear which transfers torque from a motor pinion mounted on the power shaft and a driven gear mounted on the pinion shaft. The idler shaft is confined between the drive motor and the torque transfer housing in a compact arrangement which permits efficient torque transfer in the side-by-side, parallel mounting arrangement without interferring with independent mounting adjustment of the drive motor relative to the drive pinion.

In a preferred embodiment, the structure of the drive pinion shaft is simplified by a bearing support arrangement in which one end of the pinion drive shaft is journaled within the pinion housing, with the opposite end being journalled within the gear housing on a roller bearing assembly mounted on an extended bearing surface of the driven gear and confined within the gear train housing. According to this bearing arrangement, the conventional bearing adapters are eliminated and the machining operations required for producing multiple shaft diameters for use with the bearing adapters are also eliminated.

According to the invention in its broadest aspects, the compact starter assembly comprises a drive motor, a torque transfer assembly, a gear train assembly and a housing member which stabilizes the gear train assembly and upon which the drive motor and torque transfer assembly are mounted for independent positional adjustment with respect to each other. In this arrangement, the drive motor includes a housing formed with a bore, and end plate covering the bore on one end of the housing and a rotor body having a power shaft journaled on the drive motor housing for rotation in the housing bore, with the rotor body extending through a bore and the power shaft projecting through the end plate. The end plate is furnished with an annular coupling surface which is concentric with the power shaft for mating engagement with the gear train housing member.

The torque transfer assembly includes a housing, a pinion shaft extending through the transfer housing with one end journalled for rotation on the torque transfer housing and the opposite end projecting out of the torque transfer housing. A drive pinion is axially movable on the pinion shaft into and out of mesh engagement with the flywheel gear of an engine to be started. The torque transfer housing end through which the pinion shaft projects is furnished with an annular coupling surface which is concentric with the pinion shaft for mating engagement with the gear train housing.

The gear train assembly efficiently transmits rotational torque from the drive motor to the drive pinion. The gear train assembly includes a motor pinion mounted on the power shaft, a driven gear mounted on the pinion shaft and an idler gear journalled on an idler shaft which is confined between the drive motor end plate and the gear train housing. The idler gear is journalled for rotation on the idler shaft and is disposed in mesh engagement with the motor and driven gears.

According to a preferred embodiment, the structure of the drive pinion shaft is simplified by a bearing support arrangement in which one end of the pinion drive shaft is journalled within the pinion housing, with the opposite end being journalled within the gear housing on a roller bearing assembly mounted on an extended bearing surface of the driven gear and being confined within the gear train housing. According to this arrangement, the gear train housing stabilizes the gear train assembly while providing bearing support for one end of the pinion drive shaft, and while also providing a mating surface which permits independent positional adjustment of the drive motor relative to the drive pinion. Because the drive motor and drive pinion are supported in side-by-side, parallel relation, only one machining operation is required for finishing the mating surfaces which engage the drive motor end plate and the pinion housing, as opposed to the two separate machining operations which are required for the tandem-coupled starter assemblies of the prior art.

These and other related objects and advantages of the present invention will become more apparent from the following specification, claims and appended drawings wherein:

DESCRIPTION OF THE PREFERRED EMBODIMENT

Figure 1:
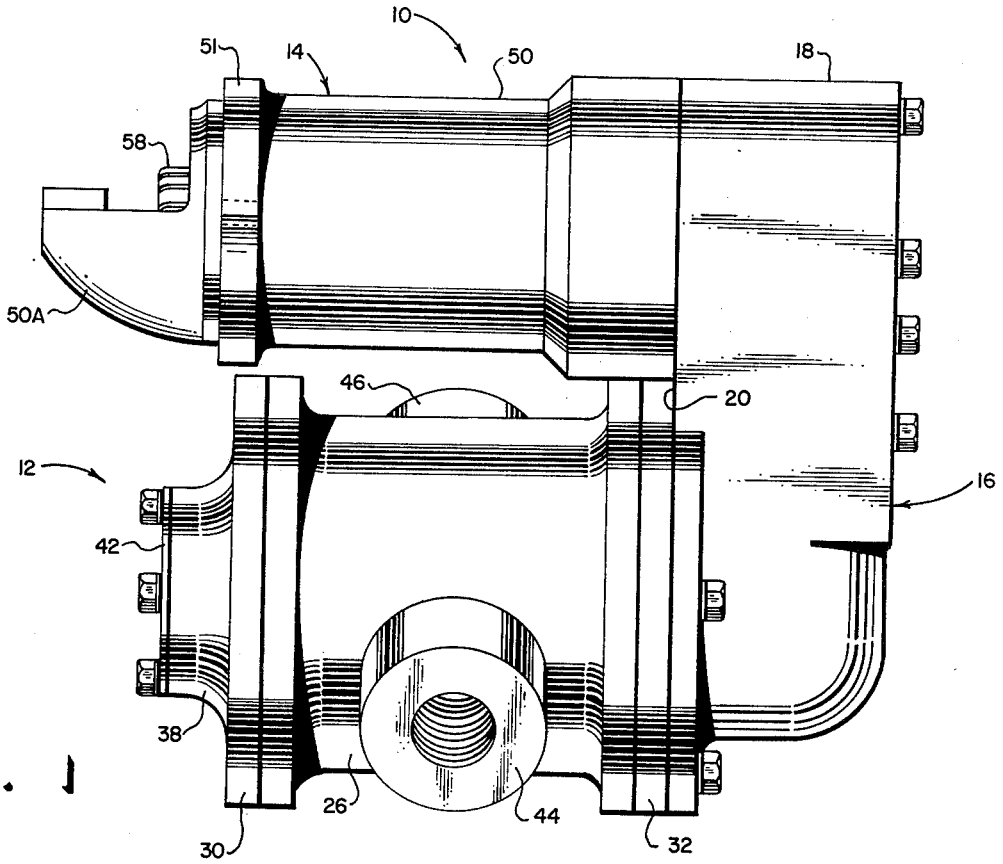
FIG. 1 is a front elevation view of a compact air starter assembly constructed according to the teachings of the invention.

In the description which follows, like parts are marked throughout the specification and drawings with the same reference numerals respectively. The figures are not necessarily drawn to scale and in some instances portions have been exaggerated in order to more clearly depict certain features of the invention.

Figure 2:
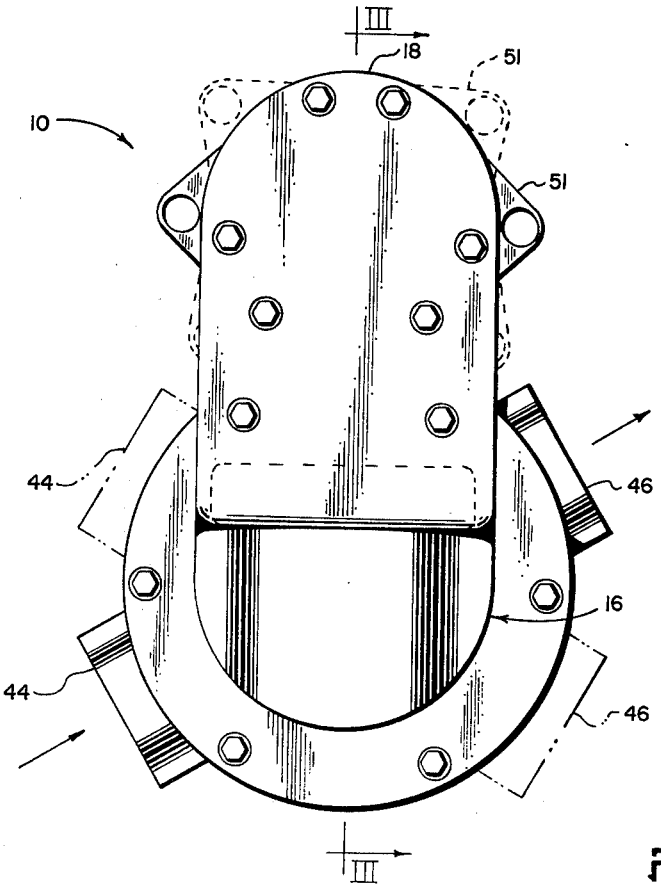
FIG. 2 is a right side elevation view of the air starter assembly shown in FIG. 1.

Referring now to FIG. 1, a compact starter assembly 10 constructed according to the teachings of the invention is illustrated. The starter assembly includes an air motor 12, a drive pinion 14 and a gear train 16. The gear train 16 is enclosed within a housing 18 having a coupling surface 20 which permits the drive motor and drive pinion to be positionally rotated independently with respect to each other, as shown in FIG. 2, for accomodating the mounting clearance requirements of different engines.

Figure 3:
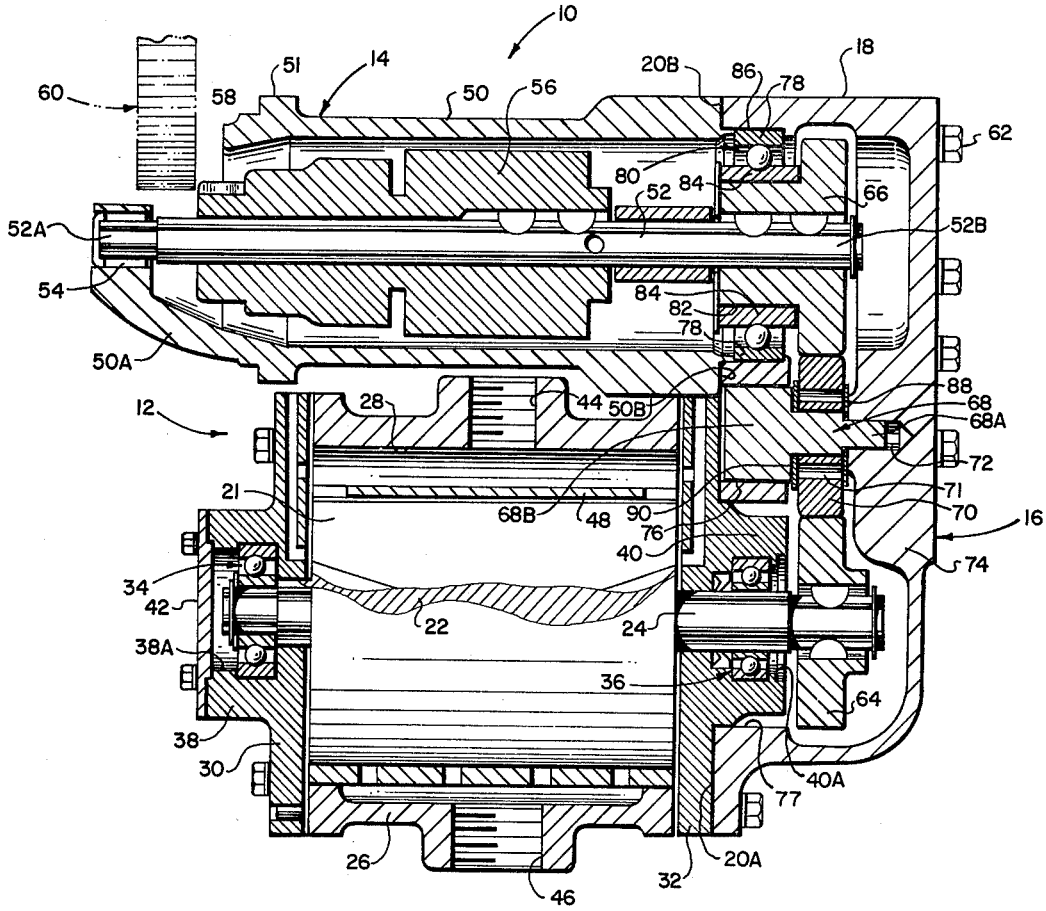
FIG. 3 is a sectional view of the air starter assembly taken along the lines III—III of FIG. 2.
Figure 4:
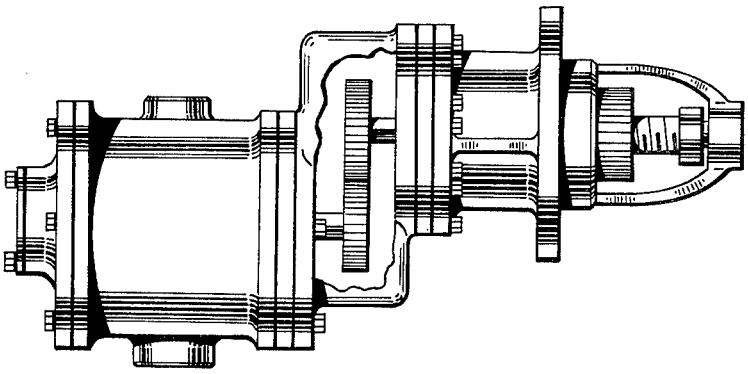
FIG. 4 (PRIOR ART)
FIG. 4 is a front elevational view, partly broken away, of a prior art air starter assembly.

Referring now to FIGS. 1 and 3, the drive motor 12 is preferably of the vane type having a plurality of vanes 21 slidibly mounted in radial slots within a rotor 22 which is mounted for rotation on a power shaft 24. The air motor 12 further includes a housing 26 having a cylindrical bore 28 in which the rotor 22 is excentrically disposed. The cylindrical bore 28 is closed on each end by end plates 30, 32. The power shaft 24 is rotatably journalled on conventional ball bearing assemblies 34, 36, respectively. Eacn end plate is provided with a hub 38, 40, respectively, each hub having a bearing cavity 38A, 40A for receiving the bearing assemblies 34, 36, respectively. The cavity 38A is sealed by a dust cover 42, while the opposite cavity 40A is open. The power shaft 24 projects through the open cavity 40A and into the gear train housing 18.

The air motor 12 further is provided with an inlet port 44 for receiving high pressure air from a remote source (not shown). An outlet port 46 is also provided for discharging the high pressure air after it has been directed over the rotor 22. An eccentric liner 48 cooperates with the rotor 22 and vanes 21 to form a plurality of revolving chambers whose volumes vary with the rotational position around the motor. With the sudden inrush of high pressure air through the inlet port 44, a turning force is developed as the rotor 22 turns in response to the flow of air through the revolving chambers, thereby producing torque. This turning force is transmitted to the flywheel of an engine to be started by the gear train assembly 16 and the drive pinion 14.

Referring now to FIG. 3, the drive pinion assembly includes a housing 50, a mounting flange 51, a pinion shaft 52 extending through the pinion housing and having one end 52A journalled within a needle bearing assembly 54, and an opposite end 52B projecting out of the opposite end of the pinion housing. Mounted for limited axial sliding movement along the pinion shaft 52 is an inertial gear assembly 56 having teeth 58 for a mesh engagement with the flywheel 60 of an engine to be started (not shown).

According to a preferred installation procedure, the nose cone 50A of the drive pinion 14 is inserted into the flywheel housing of the engine to be started and the mounting flange 51 of the drive pinion is properly aligned with existing bolt openings within the flywheel housing and the assembly is bolted in place. Prior to this installation step, the thru bolts 62 have been loosened, if necessary, to permit angular rotation of the drive pinion 14 relative to the air motor 12, in order to properly align the nose cone window with the flywheel 60. Further, the positional orientation of the air motor 12 relative to the drive pinion assembly 14 is adjusted prior to installation whereby the inlet port and outlet ports 44, 46 are properly arranged within the available mounting space on the engine to be started, and which permits easy coupling engagement and decoupling of high pressure conduits (not shown).

Figure 5:
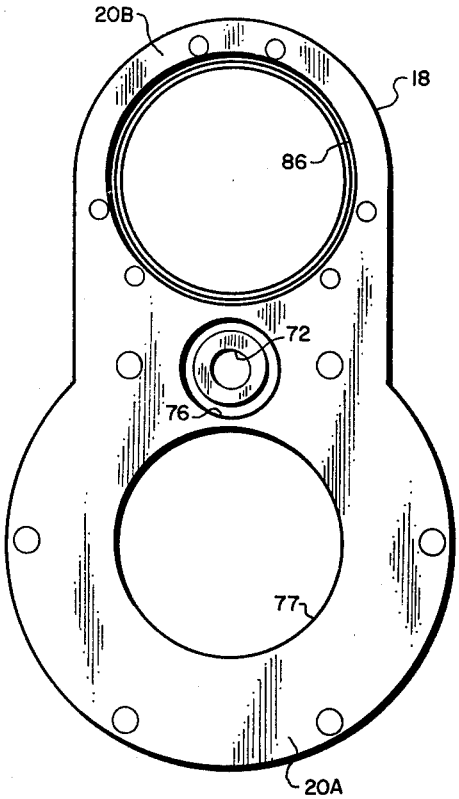
FIG. 5 is an elevation view which shows the coupling surfaces of a gear train housing.
Figure 6:
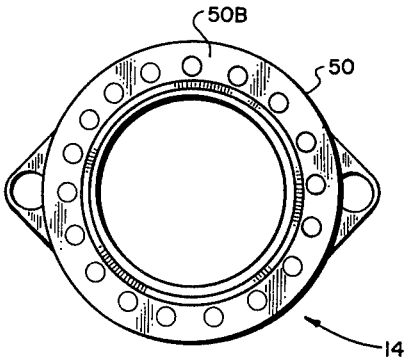
FIG. 6 is an elevation view which shows the coupling surfaces of a drive pinion housing.

The independent positional adjustment of the air motor 12 and drive pinion assembly 14 is made possible by the planar coupling surface 20 which is formed on the perimeter of the gear train housing 18 as can best be seen in FIG. 5. This coupling surface provides two annular coupling surface areas 20A and 20B for mating engagement with the end plate 32 and the open end of 50A of the pinion housing, respectively. The coupling surfaces 20A, 20B are preferably substantially coplanar with each other so that their surfaces can be prepared in a single machining operation. As can best be seen by reference to FIGS. 3 and 5, the coupling surface 20A is annular and is concentric with the power shaft 24, while the coupling surface 20B is also annular and is concentric with the pinion shaft 52. This concentric, annular coupling surface arrangement permits the air motor and the drive pinion assembly to be adjusted independently with respect to each other, without interferring with operation of the gear train assembly 16. The end plate 32 is provided with an annular, planar surface 32A for mating engagement with the coupling surface 20A, and the pinion housing is provided with an annular coupling surface 50B (FIG. 6) for mating engagement with the annular surface 20B.

According to an important feature of the invention, the gear train assembly 16 comprises a first gear 64 mounted on the power shaft 24, a second gear 66 mounted on the pinion shaft end 52B, an idler shaft 68 confined between the drive motor end plate 32 and the gear train housing 18, and an idler gear 70 mounted on a needle bearing assembly 71 for rotation on the idler shaft and disposed in mesh engagement with the first and second gears. As can best be seen in FIG. 3, the idler shaft 68 has a reduced diameter end 68A received within a bore 72 formed within a built up hub portion 74 of the gear train housing. The idler shaft 68 also has a large diameter end 68B which is confined within a cylindrical bore 76 which is preferably integrally formed with the gear train housing 18.

Gear train housing 18 is machined to receive and confine an outer race 78 of a roller bearing assembly 80. According to an important feature of the invention, the second gear 66 is provided with a reduced diameter bearing collar 82 around which an inner race 84 is received in an interference fit. The outer race 78 is confined within a counter bore 86 of the housing 18. The outer race 78 is confined axially by the engagement of the gear train housing 18 with the pinion housing 50.

The idler gate 70 is spaced with respect to the gear train housing hub 74 and the idler shaft collar by shims 88, 90.

According to the foregoing preferred embodiment, the drive pinion assembly 14 is mounted in parallel, side-by-side relation with the air motor 12 in a compact arrangement which is especially well suited for use as a universal starting motor for gasoline as well as diesel engines. It should be apparent that a hydraulic or electrically driven motor could be substituted for the air motor 12 and used to good advantage as a compact starter assembly. Because the gear train is stabilized by the coacting engagement of the idler shaft with the gear train housing and motor end plate, as well as the mounting and stabilizing arrangement for the main pinion bearing, a very compact and robust starter assembly is provided. Additionally, because the gear train housing provides separate coupling surfaces, the angular orientation of the drive motor and pinion relative to each other can be adjusted independently of each other, in order to accommodate the variable mounting geometry and limited mounting spaces available in different engines.

It will be apparent to those skilled in the art that the invention may be embodied in other specific forms without departing from the spirit or essential characteristics thereof. The present embodiment should therefore be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Patent is:

1. A compact starter assembly comprising, in combination:

a drive motor assembly including a housing formed with a bore, an end plate covering the bore on one end of the housing, and a rotor body having a power shaft journalled on the drive motor housing for rotation in the housing bore, the rotor body extending through the bore with the power shaft projecting through the end plate;

the end plate having an annular coupling surface concentric with the power shaft;

a drive pinion assembly including a housing, a pinion shaft extending through the pinion housing and having one end journalled for rotation on the pinion housing and the opposite end projecting out of the pinion housing, and a drive pinion gear axially movable on the pinion shaft into and out or mesh engagement with the flywheel gear of an engine to be started;

the pinion housing end through which the pinion shaft projects having an annular coupling surface concentric with the pinion shaft; and a gear train assembly coupling the power shaft in driving engagement with the pinion shaft, the gear train assembly including a housing having a first coupling surface disposed in mating engagement with the end plate coupling surface and a second coupling surface disposed in mating engagement with the pinion housing coupling surface, the drive pinion assembly and the drive motor assembly being mounted on the gear train housing in side-by-side relation with the drive motor power shaft extending in parallel relation with the pinion shaft.

2. The compact starter assembly as defined in claim 1, said gear train assembly comprising:

a first gear mounted on the power shaft and enclosed by the gear train housing;

a second gear mounted on the pinion shaft and enclosed by the gear train housing;

an idler shaft confined between the drive motor end plate and the gear train housing; and an idler gear journalled for rotation on the idler shaft and disposed in mesh engagement with the first and second gears.

3. The starter assembly as defined in claim 1, the gear train assembly including a gear mounted on said opposite end of the pinion shaft said gear having a bearing collar extending axially along said pinion shaft, the combination including a bearing member engaging said bearing collar and supporting said pinion shaft for rotation, said bearing member having a race confined between the gear train housing and the pinion housing.

* * * * *